United States Patent [19]

Morishita et al.

[11] 4,356,032

[45] Oct. 26, 1982

[54] METHOD OF DEPHOSPHORIZING MOLTEN PIG IRON

[75] Inventors: Hitoshi Morishita; Hajime Bada; Fumio Sudo, all of Chiba, Japan

[73] Assignee: Kawasaki Steel Corporation, Kobe, Japan

[21] Appl. No.: 276,508

[22] Filed: Jun. 23, 1981

[30] Foreign Application Priority Data

Jun. 28, 1980 [JP] Japan ..... 55-88081

[51] Int. Cl.[3] ..... C21C 7/02

[52] U.S. Cl. ..... 75/52; 75/58; 75/60

[58] Field of Search ..... 75/51, 52, 58, 59, 60

[56] References Cited

U.S. PATENT DOCUMENTS 3,771,998 11/1973 Knuppel ..... 75/52

*Primary Examiner*—P. D. Rosenberg

*Attorney, Agent, or Firm*—Balogh, Osann, Kramer, Dvorak, Genova & Traub

[57] ABSTRACT

A method of dephosphorizing molten pig iron, wherein molten pig iron is charged into a refining vessel provided at its bottom with tuyeres for blowing gas and, if necessary, at its top with a gas injecting member, and a powdery refining agent together with the blowing gas is blown into molten pig iron through the tuyeres, while a flux for the refining agent is charged into the refining vessel to perform desiliconization and subsequent dephosphorization of molten pig iron, is disclosed. This method comprises (a) charging a coolant together with molten pig iron into the refining vessel to control a temperature of molten pig iron during the blowing to a range of 1,250°–1,450° C.;

(b) blowing the powdery refining agent into molten pig iron so as to adjust a value of slag basicity after the treatment to not less than 2.5; and (c) blowing the blowing gas at a rate of not less than 0.5 $Nm^3$/min.t so that a net oxygen quantity is 8–15 $Nm^3$ per ton of molten pig iron.

10 Claims, 12 Drawing Figures

METHOD OF DEPHOSPHORIZING MOLTEN PIG IRON

This invention relates to a method of dephosphorizing molten pig iron, and more particularly it is to provide a method of dephosphorizing molten pig iron wherein an oxygen bottom-blown or top and bottom-blown converter or other similar vessels is used as a refining vessel, molten pig iron is charged into the refining vessel, a powdery refining agent consisting mainly of lime is blown from the bottom of the refining vessel into molten pig iron together with a refining gas, particularly oxygen gas as a carrier gas to perform desiliconization and subsequent dephosphorization of molten pig iron.

From a viewpoint of steel quality, there are strongly demanded super-low phosphorus steels. However, it is usually difficult to considerably reduce the phosphorus content of molten pig iron in the blast furnace operation under current circumstances for raw materials.

Now, it is particularly important to perform the dephosphorization of molten pig iron before the steel-making step in order to stabilize the dephosphorization state at the step.

As a preliminary dephosphorization treatment of molten pig iron, there have hitherto been proposed the use of burnt lime as a flux and the use of soda ash as a dephosphorizing agent in *Tetsu-to-Hagané,* 1977, Vol. 63, No. 12, pp 1801–1808, *Seitetsu Kenkyu,* 1979, No. 299, pp 13057–13116, and the like.

In the former case, it is intended to perform the dephosphorization by merely contacting the flux with molten pig iron. For this purpose, it is indispensable to use a flux giving a low basicity ($CaO/SiO_2$) and having a high iron oxide (FeO) content. As a result, the oxidation loss of manganese becomes high, the dephosphorization ratio is not so high, and further flux consumption increases.

In the latter case, soda ash possesses both high dephosphorization and desulfurization ratios, but its unit cost is high. Further, the evaporation loss is large in the use, so that it is difficult to perform high-temperature treatment. And also, the erosion of refractory is conspicuous and hence the material cost becomes higher.

Moreover, the conventional technics for preliminary dephosphorization treatment of molten pig iron including the above mentioned processes generally take a long time of approximately 20 minutes or more, so that they come into question in view of productivity.

Besides, there is a so-called double-blowing process in a top-blown converter. In this case, an oxidizing slag is produced by a first blowing to conduct the dephosphorization, but this procedure usually takes 10 to 15 minutes and is problem in the productivity. Particularly, the carbon content of molten pig iron is reduced up to 2 to 2.5%, so that recarburization is usually required in the second blowing.

Now, the inventors have aimed at dephosphorization behavior appeared at an initial blowing stage in a bottom-blown converter capable of easily achieving an equilibrium between slag and metal. That is, as apparent from FIG. 1 illustrating an example of variations of phosphorus content in molten metal during the oxygen blowing, the reduction of phosphorus content is caused at an initial blowing, i.e. until the total oxygen blowing quantity reaches approximately 20 $Nm^3$ per ton of molten metal at an oxygen blowing rate of 3 $Nm^3/min \cdot t$ (in 6–7 minutes after the start of the blowing). Moreover, if iron ore is added as an auxiliary material during the blowing, the total oxygen blowing quantity may include oxygen produced from the iron ore (1 kg of the iron ore produces oxygen gas corresponding to 0.2 $Nm^3$).

In this case, however, the ultimate phosphorus content is 0.040–0.070% at most. Therefore, it is still insufficient to apply the dephosphorization behavior at the initial blowing stage in the bottom-blown converter as it is to the preliminary dephosphorization treatment for molten pig iron.

The inventors have made further investigations and experiments with respect to conditions for reducing the ultimate phosphorus content at the above initial blowing stage of the bottom-blown converter to a value suitable as the preliminary dephosphorization treatment for molten pig iron, and as a result it has been found that a considerably low ultimate phosphorus content can advantageously be realized by the method as mentioned below in a very short time without substantially producing oxidation loss of manganese, whereby the bottom-blown converter can properly be utilized for the preliminary dephosphorization treatment of molten pig iron.

According to the invention, there is the provision of a method of dephosphorizing molten pig iron wherein the molten pig iron is charged into a refining vessel provided at its bottom with tuyeres for blowing gas and, if necessary, at its top with a gas injecting member, a powdery refining agent which may consist of a calcium oxide source (compound) acting to produce a dephosphorizing reaction together with the blowing gas is blown into the molten pig iron through the tuyeres, while a flux for the refining agent to the molten pig iron, for reducing the viscosity and melting point of the resulting slag, is charged into the refining vessel to perform desiliconization and subsequent dephosphorization of the molten pig iron, which comprises:

(a) charging a coolant together with the molten pig iron into the refining vessel to control a temperature of the molten pig iron during the blowing to a range of 1,250°–1,450° C.;

(b) blowing the powdery refining agent into the molten pig iron so as to adjust a value of slag basicity after the treatment to not less than 2.5;

and (c) blowing the blowing gas at a rate of not less than 0.5 $Nm^3/min$ per ton of molten pig iron so that the net oxygen quantity used is 8–15 $Nm^3$ per ton of molten pig iron.

According to the invention, the bottom-blown converter using an oxygen gas as a blowing gas is effectively utilized for the dephosphorization of molten pig iron. Further, the invention is applicable to oxygen refining furnaces or other similar vessels such as top and bottom-blown converter and the like as far as they have functions similar to those of the bottom-blown converter.

According to the method of the invention, not only the phosphorus content of molten pig iron can considerably be reduced in a very short time, but also the necessarily produced desiliconization is secondarily accompanied with an effective desulfurization, so that the invention is particularly useful as the preliminary treatment for molten pig iron prior to the steel-making and refining steps. That is, the invention is advantageously adaptable to overcome various problems in the steel-making step because the thus treated molten pig iron is applicable to, for example, a slagless converter.

The term "net oxygen quantity" used herein means to be a total oxygen quantity during the blowing including oxygen quantity produced from the charge of iron ore as the coolant but excluding oxygen quantity consumed by the desiliconization reaction.

The invention will now be described with reference to the accompanying drawings, wherein.

Figure 6A:
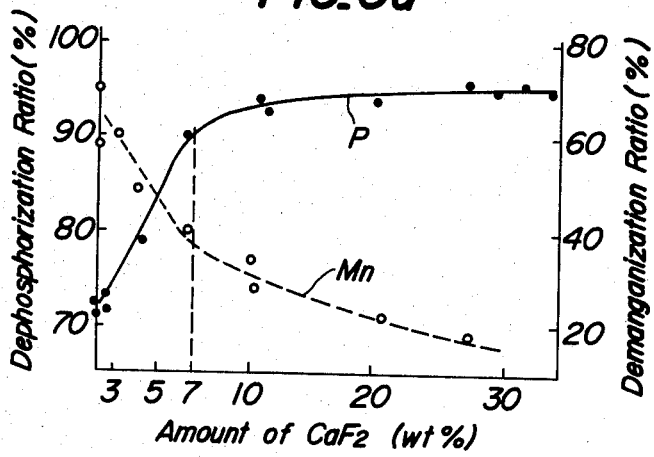
Figure 6B:
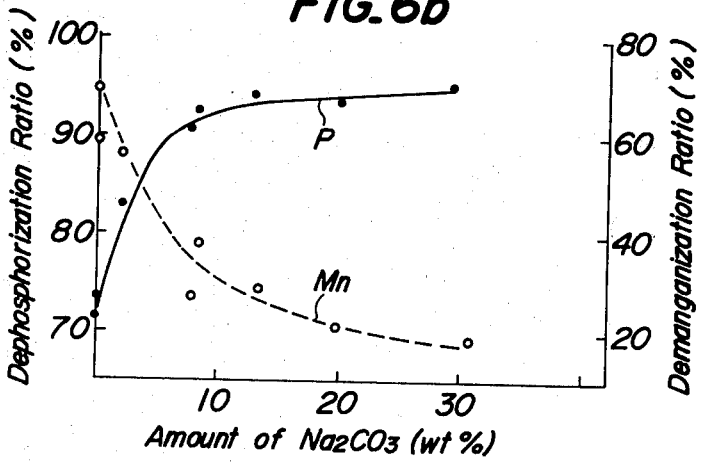
Figure 7:
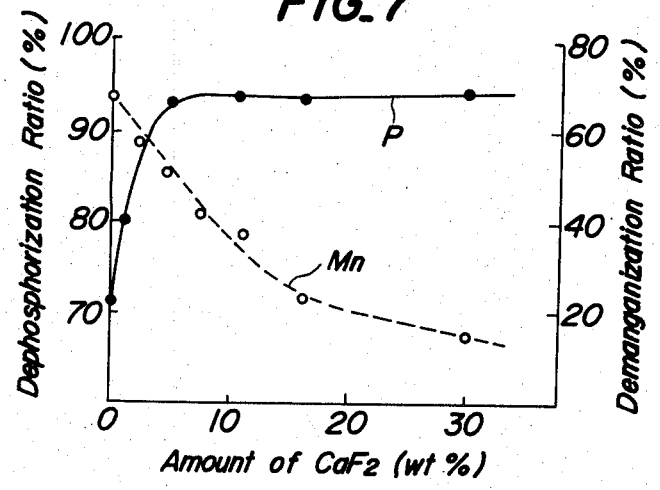
Figure 8:
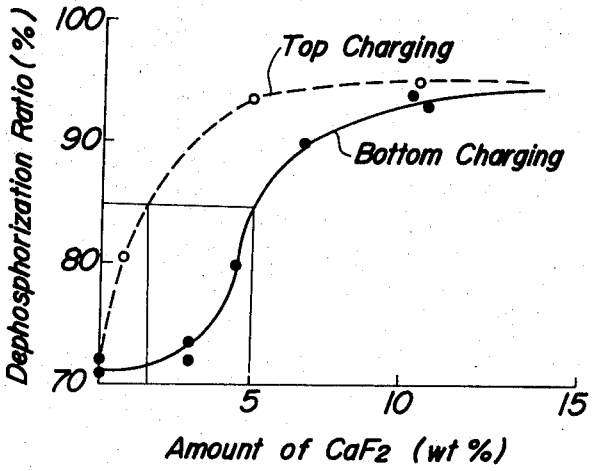
Figure 9:
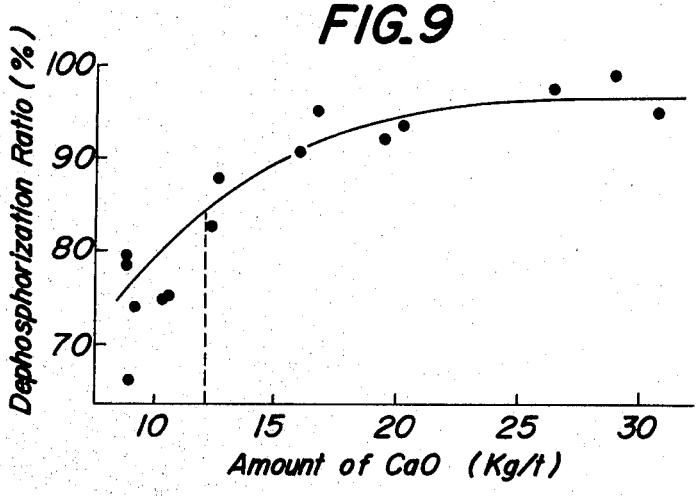
Figure 10:
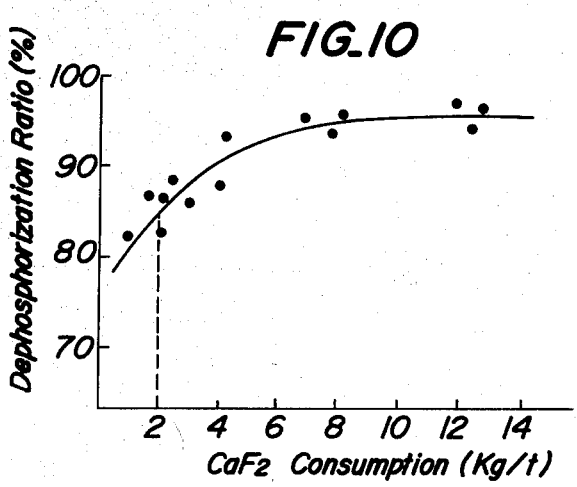
Figure 11:
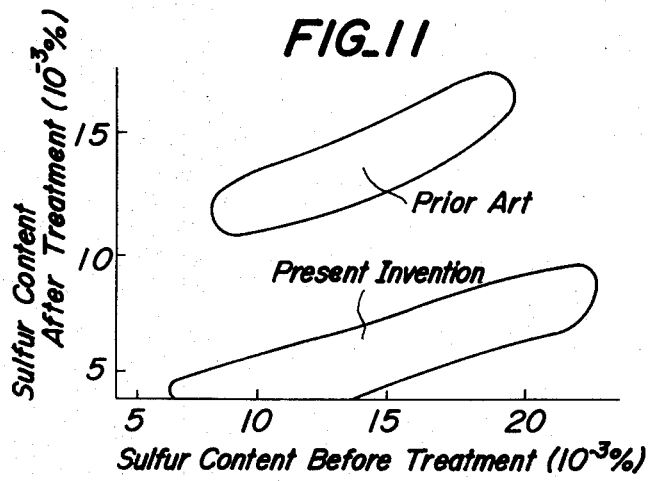

FIG. 6*a* is a graph showing a relation between the mixing amount of $CaF_2$ as a flux and the dephosphorization ratio;

FIG. 6*b* is a graph showing a relation between the mixing amount of $Na_2CO_3$ as a flux and the dephosphorization ratio;

FIG. 7 is a graph showing a relation between the mixing amount of lumpy fluorite charged from the top of the vessel and the dephosphorization ratio;

FIG. 8 is a graph showing influences of the bottom-blowing and top charging of fluorite on the dephosphorization ratio;

FIG. 9 is a graph showing a relation between the amount of CaO used and the dephosphorization ratio;

FIG. 10 is a graph showing a relation between the consumption of fluorite per ton of molten pig iron and the dephosphorization ratio; and FIG. 11 is a graph showing an effect of the method according to the invention on the desulfurization.

In order to achieve the object of the invention, the slag basicity after the treatment of molten pig iron, net oxygen quantity, treating temperature and gas bottom-blowing quantity are considerably important, experimental results of which will be described below.

The experiment is made as follows: That is, molten pig iron having a chemical composition of about 4.6% of C, 0.2–0.4% of Si, about 0.4% of Mn, about 0.14% of P, about 0.02% of S and the remainder of Fe is tapped out from the blast furnace and charged into the bottom-blown converter or top and bottom-blown converter at a temperature of about 1,380° C. together with a necessary amount of iron ore or manganese ore for controlling the temperature rise of molten pig iron accompanied with the blowing treatment, and then a powdery refining agent is blown into molten pig iron from the bottom of the converter together with oxygen gas as a carrier gas.

In this experiment, 30 kg/t of CaO as the powdery refining agent and 4 kg/t of $CaF_2$ as a flux are blown into molten pig iron together with 3 $Nm^3$/min·t of oxygen gas from the bottom of the converter in such a manner that the net oxygen quantity is 10–15 $Nm^3$/t in 2–3 minutes. After this treatment, the temperature of molten pig iron is controlled to about 1,370° C. In this case, calcium oxide (CaO) is used as the powdery refining agent, but calcium carbonate ($CaCO_3$) may also be used.

Figure 2:
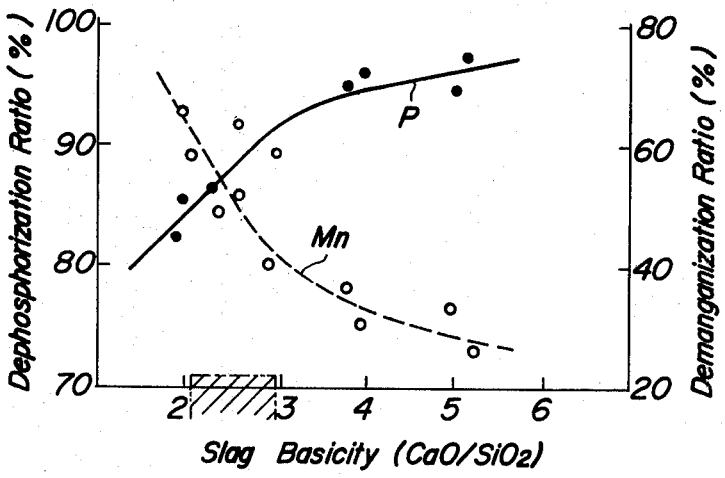
FIG. 2 is a graph showing an influence of the slag basicity on the dephosphorization ratio.

First of all, the influence of slag basicity ($CaO/SiO_2$) on the dephosphorization and demanganization ratios are examined to obtain a result as shown in FIG. 2.

In FIG. 2, each value of dephosphorization and demanganization ratios taken on the ordinate is given by the following equation:

$$\frac{E_i - E_f}{E_i} \times 100$$

wherein E represents a phosphorus or manganese content of molten pig iron, suffix i is the case before treatment and suffix f is the case after treatment, while the value of slag basicity ($CaO/SiO_2$) taken on the abscissa is given by increasing or decreasing the amount of CaO on the basis of 30 kg/t. Moreover, a solid line represents the dephosphorization ratio and a broken line represents the demanganization ratio.

For the reference, the dephosphorization ratio in the conventional oxygen bottom-blown converter is shown by a dot-dash line in FIG. 2, from which it is obvious that the value of the resulting slag basicity $CaO/SiO_2$ changes within a range of 2–3 at an initial blowing stage, i.e. over 6, 7 minutes after the start of the blowing, during which the dephosphorization ratio reaches only about 60%.

As can be seen from FIG. 2, according to the invention, the higher the slag basicity ($CaO/SiO_2$) after the treatment, the higher the dephosphorization ratio and the lower the demanganization ratio. That is, when the value of $CaO/SiO_2$ is not less than 2.5, the conspicuous increase of dephosphorization ratio and reduction of demanganization ratio are simultaneously realized, while when $CaO/SiO_2$ value is less than 2.5, the dephosphorization ratio is not improved so much and the reduction of demanganization ratio is insufficient. Moreover, if the basicity is too high (i.e. it exceeds 6), the addition effect of CaO tends to be saturated and the excessive consumption of CaO brings about the increase of procedure cost.

Figure 3:
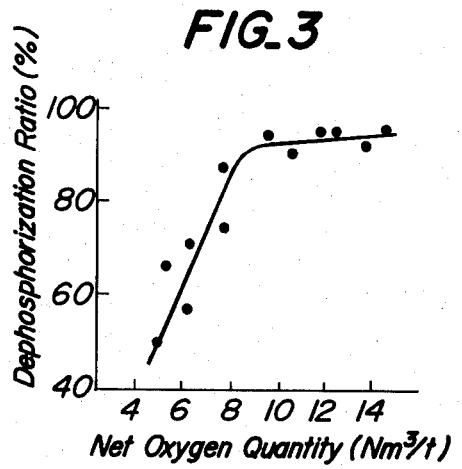
FIG. 3 is a graph showing a relation between the net oxygen quantity and the dephosphorization ratio.

Secondly, the influence of oxygen blowing quantity on the dephosphorization ratio is examined to obtain a result as shown in FIG. 3, wherein an abscissa represents the net oxygen quantity, i.e. oxygen quantity obtained by subtracting the oxygen quantity consumed in the desiliconization from the sum of oxygen quantity produced from the charged iron ore and the like and oxygen quantity to be blown. As apparent from FIG. 3, when the net oxygen quantity is less than 8 $Nm^3$ per ton of molten pig iron, the dephosphorization ratio of at least about 85% required for the preliminary dephosphorization treatment of molten pig iron cannot be obtained, while when the net oxygen quantity is not less than 8 $Nm^3$/t, the sufficiently high dephosphorization ratio can be obtained. Moreover, when considering the temperature rise of molten pig iron at the steel-making and refining steps after the preliminary treatment according to the invention without additional recarburization, the carbon content of molten pig iron is necessary to be about 3.0%. Therefore, the net oxygen quantity is necessary to be not more than 15 $Nm^3$/t in order to avoid the decarburization exceeding the above carbon content.

Figure 4:
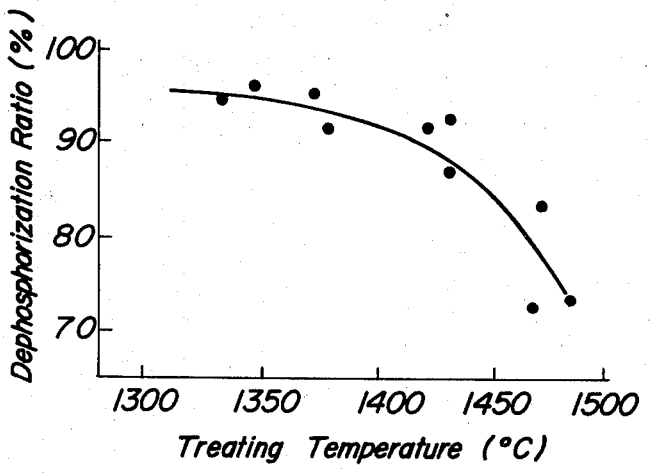
FIG. 4 is a graph showing a relation between the treating temperature of molten pig iron and the dephosphorization ratio.

Thirdly, the influence of treating temperature on the dephosphorization ratio is examined by increasing or decreasing the amount of iron ore as a coolant to be charged together with molten pig iron into the refining vessel to vary the temperature of molten pig iron within a range of 1,300–1,500° C. under such a condition that the slag basicity ($CaO/SiO_2$) after the treatment is adjusted to 3.7–4.2 by using 30 kg/t of CaO as the powdery refining agent and the amount of $CaF_2$ corresponding to 13.3% of the CaO amount and the measured results are shown in FIG. 4, from which it can be seen that the lower the treating temperature, the higher the dephosphorization ratio. As a coolant, use may be made of iron ore, manganese ore, mill scale, scrap and the like.

In order to avoid a further dephosphorization at the steel-making and refining steps after the preliminary dephosphorization treatment of molten pig iron, it is generally necessary to obtain the dephosphorization ratio of not less than 85% at the preliminary dephosphorization treatment of molten pig iron. That is, the phosphorus content of molten pig iron is usually 0.1–0.15%, while the phosphorus content required for slagless refining is 0.02%, so that it is required to obtain the dephosphorization ratio of at least 85% at the preliminary dephosphorization treatment of molten pig iron.

Viewing from FIG. 4, the upper limit of the treating temperature satisfying the above requirement is 1,450° C., while the lower limit is required to be 1,250° C. so as to prevent the solidification of molten metal due to the temperature drop up to subsequent step.

Figure 5:
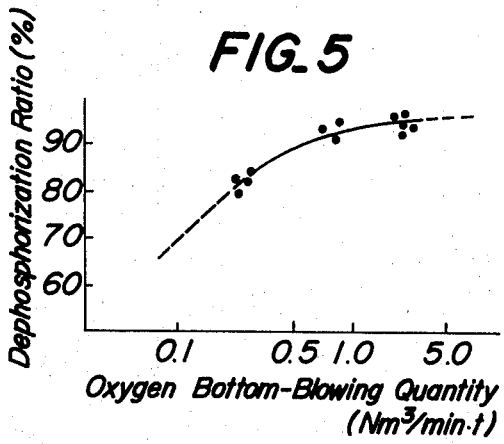
FIG. 5 is a graph showing a relation between the gas bottom-blowing quantity and the dephosphorization ratio.

Finally, the influence of oxygen bottom-blowing quantity on the dephosphorization ratio is examined to obtain a result as shown in FIG. 5.

In this case, iron ore as a coolant is charged into the top and bottom-blown converter in an amount enough to control the temperature of molten pig iron to 1,370° C. together with molten pig iron. Then, oxygen gas is blown from the bottom of the converter into molten pig iron together with 30 kg/t of CaO as a powdery refining agent and $CaF_2$, as a flux additive corresponding to 13.3% of the CaO amount in such a manner that the net oxygen quantity inclusive of oxygen quantity produced from the iron ore is 12–14 $Nm^3$ per ton of molten pig iron. Particularly, the dephosphorization ratio is measured by changing the oxygen bottom-blowing quantity to 3 $Nm^3$/min·t, 0.8 $Nm^3$/min·t and 0.3 $Nm^3$/min·t, respectively.

As apparent from FIG. 5, the dephosphorization ratio of not less than 85% is achieved by blowing oxygen gas from the bottom of the converter at a rate of not less than 0.5 $Nm^3$/min per ton of molten pig iron with good stirring.

Figure 1:
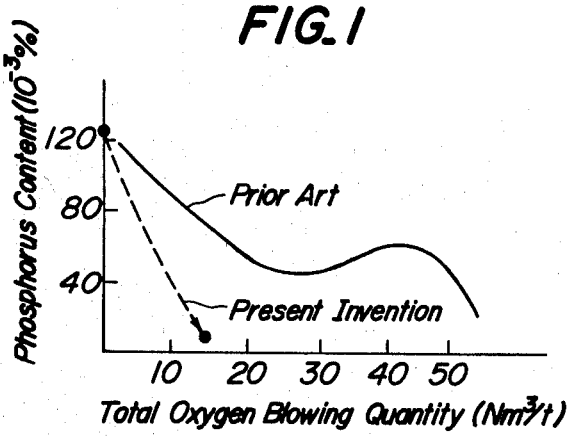
FIG. 1 is a graph showing the dephosphorization behavior in the conventional bottom-blown converter as mentioned above.

When the preliminary dephosphorization treatment of molten pig iron according to the invention satisfying all of four requirements as described above is shown in FIG. 1 as a function of the net oxygen quantity, it is apparent that the conspicuous reduction of phosphorus content (shown by broken line) is realized in a very short time as compared with that at the initial blowing stage in the conventional bottom-blown converter.

According to the conventional dephosphorization inside the top-blown converter or the oxidation refining outside the furnace, the slag usable for the dephosphorization is important to include a large amount of iron oxide in addition to the high basicity. On the contrary, the invention does not need the addition of iron oxide to the slag as apparent from the above mentioned experimental results, which is quite opposite to the common sense relating to the slag conditions in the conventional dephosphorization due to oxidation.

That is, there are considered the following two cases in the dephosphorization due to oxidation:

(I) oxidation of phosphorus in molten metal; and (II) absorption of oxidized phosphorus into slag. In order to achieve the case (I), the prior art has been required to use an oxidizing slag, while according to the invention, phosphorus is oxidized by oxygen gas blown from the bottom of the vessel and at the same time migrates into CaO entrained with the oxygen gas. In the invention, therefore, the removal of phosphorus from molten pig iron can rapidly be attained, and also the rephosphorization does not occur in molten pig iron owing to the low-temperature operation due to high basicity slag.

The influence of a flux for the powdery refining agent on the dephosphorization and demanganization will be described below.

The flux serves to promote the slag formation of the powdery refining agent and is charged into molten pig iron in the following manners:

(i) the flux is mixed with the powdery refining agent and blown into molten pig iron together with the blowing gas as a carrier gas from the bottom of the vessel;

(ii) the flux is charged into molten pig iron from the top of the vessel independently of the addition of the powdery refining agent; and (iii) the flux is charged by the combination of the above cases (i) and (ii).

As the flux, mention may be made of fluorite ($CaF_2$), soda ash ($Na_2CO_3$), cryolite, colemanite, red mud and the like. According to the invention, the flux is used in an amount of 2 to 30% by weight per the powdery refining agent (CaO). Moreover, the red mud may be used in an amount of 10–45% by weight.

In the case (i), the fluorite as a flux is added together with the powdery refining agent to molten pig iron, whereby the viscosity of the resulting slag is lowered during the treatment to enlarge the reaction surface area against molten pig iron and hence the dephosphorization effect is enhanced. Particularly, the addition of powdery fluorite passing through tuyeres at the bottom of the vessel increases a chance of contacting with powdery lime as a refining agent, which is effective for early and surely lowering the slag viscosity.

In FIGS. 6*a* and 6*b* are shown influences of $CaF_2$ and $Na_2CO_3$ as a powdery flux to be mixed with the powdery refining agent on both the dephosphorization and demanganization ratios, respectively.

In this case, the value of basicity ($CaO/SiO_2$) after the treatment is adjusted to a range of 3.7–4.2 by using 30 kg/t of CaO, and the amount of $CaF_2$ or $Na_2CO_3$ is varied up to 30% by weight per CaO. Moreover, the temperature of molten metal after the treatment is controlled to approximately 1,370° C.

As can be seen from FIGS. 6*a* and 6*b*, when the amount of flux is less than 3%, the addition effect is less, but when the amount of flux is not less than 3%, it develops the remarkable effect on the improvement of dephosphorization ratio and the reduction of demanganization ratio. Particularly, the amount of flux is preferable within a range of 7–30% by weight, which is due to the fact that the resulting slag is softened to increase the rate of reaction as a result of the observation of reaction system.

In general, the fluorite as a flux is available as a lumpy material. Therefore, it is necessary to pulverize the lumpy fluorite in order to blow the powdery flux together with the powdery refining agent into molten pig iron as in the case (i). In the pulverization of lumpy fluorite, however, the use of large grinding equipment is required in addition to the power and fuel. And also, it is required to use various installations such as pipelines for transporting from the grinding equipment to steel-making factory, pipeline for carrier gas, storage tanks and the like. Therefore, there may be caused problems such as the increase of maintenance cost for these installations or the like.

Now, the inventors have made experiments with the case (ii) and found out that an unexpectedly better effect is obtained when the lumpy fluorite is directly charged onto molten pig iron from the top of the refining vessel. In this case, the charging of lumpy fluorite can be performed by applying a chute for auxiliary material always installed in a usual steel-making factory without using many installations inclusive of the aforementioned grinding equipment, and as a result, the dephosphorization ratio equal to or higher than that of the prior art is obtained, which is related to considerable reduction of treatment cost in molten pig iron.

That is, various experiments were made in order to elucidate the dephosphorization mechanism during the preliminary treatment of molten pig iron in the bottom-blown converter, i.e. the unclear point whether the remarkable addition effect of the fluorite on the dephosphorization is the contribution to powdery lime blown from the bottom tuyeres of the vessel or the action to the slag existent on molten pig iron. As a result, when the lumpy fluorite is charged from the top of the vessel without changing the other operational factors, the dephosphorization result is fairly high as compared with the case of blowing the powdery fluorite together with the powdery refining agent. Consequently, the amount of fluorite used can be decreased.

As previously mentioned, the case of blowing the powdery fluorite together with lime as the powdery refining agent from the bottom tuyeres is shown in FIG. 6*a*. On the contrary, the case of blowing powdery lime through the bottom tuyeres and charging the lumpy fluorite from the top of the vessel is shown in FIG. 7. As can be seen from the comparison of FIGS. 6*a* and 7, even when using the lumpy fluorite, the tendency for the improvement of the dephosphorization ratio and the reduction of the demanganization ratio is similar to the case of FIG. 6*a*. Particularly, it should be noted that the minimum addition amount of fluorite required for obtaining the dephosphorization ratio of 85% is 5% by weight per lime in case of blowing the powdery fluorite together with the powdery lime from the bottom tuyeres and approximately 2% by weight in case of charging the lumpy fluorite from the top of the vessel. In order to make the above more clear, the comparison of the cases (i) and (ii) with respect to only the dephosphorization ratio is shown in FIG. 8.

As apparent from FIGS. 6*a*, 7 and 8, the use of lumpy fluorite is more effective in the dephosphorization than the use of powdery fluorite. Although the reason for this result is not yet clear, the inventors have guessed that when using the powdery fluorite, a part of the fluorite charged is taken into oxygen bubbles, floats upward without contacting with the lime as the powdery refining agent, and escapes outside the vessel together with the produced gases without slag formation. That is, the addition of powdery fluorite is poor in the effect of decreasing the slag viscosity as compared with the addition of lumpy fluorite.

Although the above embodiments are described with respect to the use of fluorite or soda ash alone as a flux, similar results are obtained by using at least one flux selected from fluorite, soda ash, cryolite, colemanite and red mud.

In the use of lumpy fluorite, there is no cost for the pulverization of fluorite (power and heating cost for removal of water content) and also there is no maintenance cost for the grinding equipment and transportation pipeline. Moreover, when newly establishing installations for the preliminary dephosphorization treatment of molten pig iron in the bottom-blown refining vessel, the grinding equipment for fluorite is disused from the equipments for pulverizing lime and fluorite, so that the reduction of equipment cost can be expected.

That is, according to the invention, when the preliminary dephosphorization treatment of molten pig iron is performed by blowing the powdery refining agent together with the bottom-blowing gas into molten pig iron, the amount of the flux used for effectively promoting the dephosphorization performance can be reduced in a high contribution ratio together with the omission of the pulverizing work for the flux.

As mentioned above, the invention is an epochal dephosphorization method adaptable for usual molten pig irons. Further, the invention is effective for the dephosphorization of low-silicon molten pig iron having a silicon content of, for example, not more than 0.15%.

In the dephosphorization of such a low-silicon molten pig iron, the amount of $SiO_2$ produced is too little as against the amount of CaO charged for achieving the sufficient dephosphorization ratio. As a result, the slag basicity after the treatment becomes extremely higher to hardly produce the slag formation playing a part in the dephosphorization. According to the invention, however, the dephosphorization ratio of at least 85% can be realized in the low-silicon molten pig iron by controlling the amounts of the powdery refining agent and flux charged to a certain extent under conditions satisfying the previously mentioned four requirements.

In FIG. 9 is shown a relation between the amount of CaO and the dephosphorization ratio when molten pig iron having a silicon content of not more than 0.15% is dephosphorized at the treating temperature of 1,350° C. with 3 kg/t of fluorite as a flux by varying the amount of CaO. As apparent from FIG. 9, it is necessary to charge CaO in an amount of not less than 12 kg per ton of molten pig iron in order to achieve the dephosphorization ratio of at least 85%.

In FIG. 10 is shown a relation between the consumption of fluorite as a flux and the dephosphorization ratio when molten pig iron having a silicon content of not more than 0.15% is dephosphorized at the treating temperature of 1,350° C. with 20±2 kg/t of CaO as a powdery refining agent by varying the amount of the fluorite. As apparent from FIG. 10, it is necessary to charge the fluorite in an amount of not less than 2 kg per ton of molten pig iron in order to achieve the dephosphorization ratio of at least 85%. Even when using soda ash, cryolite, colemanite or red mud as a flux, similar results are obtained.

Moreover, when charging the flux into the refining vessel, powdery flux may be blown into molten pig iron together with the powdery refining agent and bottom-blowing gas, or lumpy flux may be charged onto molten pig iron from the top of the vessel.

According to the invention, the dephosphorization ratio can effectively be achieved by the preliminary dephosphorization treatment of molten pig iron to such an extent that dephosphorization operation at subsequent step is not required anymore. Therefore, if the dephosphorization is carried out at the subsequent step, the production of superlow phosphorus steel can simply and easily be realized.

The following examples are given for the purpose of illustration of this invention and are not intended as limitations thereof.

EXAMPLE 1

22.5 kg/t of CaO as a powdery refining agent and 2.5 kg/t of $CaF_2$ corresponding to 11% based on CaO amount were blown with 6.8 $Nm^3$ per ton of molten pig iron of bottom-blowing gas at an oxygen blowing rate of 2.7 $Nm^3$/t·min for 2.5 minutes into a bottom-blown converter wherein 260 tons of molten pig iron was charged together with 35.5 kg/t of iron ore to effect pretreatment of molten pig iron. The result as shown in Table 1 was obtained.

TABLE 1

| | Chemical components of molten pig iron (wt. %) | | | | | Temperature of molten pig iron | Slag | |
|---|---|---|---|---|---|---|---|---|
| | C | Si | Mn | P | S | (°C.) | T.Fe (%) | CaO/$SiO_2$ |
| Before treatment | 4.70 | 0.30 | 0.44 | 0.151 | 0.018 | 1,384 | — | — |
| After treatment | 3.81 | tr | 0.36 | 0.006 | 0.012 | 1,377 | 4.3 | 3.1 |

At the original stage of this blow-refining operation, 2.4 $Nm^3$ of oxygen was consumed for desiliconization and the dephosphorization ratio reached about 97%.

EXAMPLE 2

32.3 kg/t (an amount calculated as CaO: 18.1 kg/t) of $CaCO_3$ as a powdery refining agent instead of CaO and 3.0 kg/t of $CaF_2$ corresponding to 16.6% based on the calculated amount of CaO were blown with 5.8 $Nm^3$ per ton of bottom-blowing gas as a carrier gas at an oxygen blowing rate of 2.6 $Nm^3$/t·min for 2.2 minutes into a bottom-blown converter wherein 265 tons of molten pig iron was charged together with 18.1 kg/t of iron ore. The obtained result is shown in Table 2. In this example, calcium carbonate was used as the refining agent to reduce the amount of iron ore but the satisfactory desiliconization was attained as shown in Table 2.

TABLE 2

| | Chemical components of molten pig iron (wt. %) | | | | | Temperature of molten pig iron | Slag | |
|---|---|---|---|---|---|---|---|---|
| | C | Si | Mn | P | S | (°C.) | T.Fe (%) | CaO/$SiO_2$ |
| Before treatment | 4.75 | 0.21 | 0.43 | 0.150 | 0.019 | 1,390 | — | — |
| After treatment | 3.78 | tr | 0.30 | 0.004 | 0.014 | 1,357 | 2.8 | 3.5 |

EXAMPLE 3

19.4 kg/t of CaO as a powdery refining agent and 2.0 kg/t of $CaF_2$ corresponding to 10% based on the amount of CaO were blown with 7.0 $Nm^3$ per ton of molten pig iron of bottom-blowing gas as a carrier gas at an oxygen blowing rate of 2.7 $Nm^3$/t·min for 2.6 minutes into a bottom-blown converter wherein 260 tons of molten pig iron was charged together with 34.7 kg/t of manganese ore instead of iron ore. The obtained result is shown in Table 3.

TABLE 3

| | Chemical components of molten pig iron (wt. %) | | | | | Temperature of molten pig iron | Slag | |
|---|---|---|---|---|---|---|---|---|
| | C | Si | Mn | P | S | (°C.) | T.Fe (%) | CaO/$SiO_2$ |
| Before treatment | 4.65 | 0.19 | 0.36 | 0.137 | 0.021 | 1,369 | — | — |
| After treatment | 3.73 | tr | 0.54 | 0.007 | 0.011 | 1,362 | 4.7 | 4.1 |

In this example, it was possible to increase an amount of Mn in the molten pig iron by using manganese ore as a coolant. The dephosphorization ratio reached about 95%.

EXAMPLE 4

18.3 kg/t of CaO as a powdery refining agent and 3.2 kg/t of $Na_2CO_3$ corresponding to 17.5% based on the amount of CaO instead of $CaF_2$ were blown with 8.1 $Nm^3$ per ton of molten pig iron of bottom-blowing gas at an oxygen blowing rate of 2.7 $Nm^3$/t·min for 3.0 minutes into a bottom-blown converter wherein 268 tons of molten pig iron was charged together with 26.3 kg/t of iron ore. The obtained result is shown in Table 4.

TABLE 4

| | Chemical components of molten pig iron (wt. %) | | | | | Temperature of molten pig iron | Slag | |
|---|---|---|---|---|---|---|---|---|
| | C | Si | Mn | P | S | (°C.) | T.Fe (%) | CaO/$SiO_2$ |
| Before treatment | 4.73 | 0.22 | 0.51 | 0.138 | 0.028 | 1,370 | — | — |
| After treatment | 3.63 | tr | 0.42 | 0.010 | 0.012 | 1,410 | 3.5 | 3.7 |

In this example, the dephosphorization ratio reached about 93% and $Na_2CO_3$ had substantially the same activity as $CaF_2$.

EXAMPLE 5

24.2 kg/t of CaO as a powdery refining agent and 3.8 kg/t of $CaF_2$ corresponding to 15.7% based on the amount of CaO were blown with bottom-blowing gas as a carrier gas for 2 minutes by dividing 6.5 $Nm^3$ per ton of molten pig iron of oxygen in such an amount that a bottom-blowing oxygen rate is 0.8 $Nm^3$/t·min and a top-blowing oxygen rate is 2.5 $Nm^3$/t·min, into a top and bottom-blown converter wherein 270 tons of molten pig iron was charged together with 36.2 kg/t of iron ore. The obtained result is shown in Table 5.

TABLE 5

| | Chemical components of molten pig iron (wt. %) | | | | | Temperature of molten pig iron | Slag | |
|---|---|---|---|---|---|---|---|---|
| | C | Si | Mn | P | S | (°C.) | T.Fe (%) | CaO/ $SiO_2$ |
| Before treatment | 4.58 | 0.28 | 0.44 | 0.142 | 0.021 | 1,395 | — | — |
| After treatment | 3.81 | tr | 0.33 | 0.007 | 0.013 | 1,380 | 4.1 | 3.4 |

As seen from the above described examples, the treatment of the molten pig iron of about 250 tons according to the invention needs only about 2–3 minutes, while the conventional treatment using CaO needs 15–40 minutes. Accordingly, the invention can noticeably reduce the treating time and is not only advantageous in view of the productivity but also the ultimate phosphorus content is very low. The above described conventional treatment is only to reduce a load of dephosphorization in the refining in the next step of converter, while in the treatment of the invention, the dephosphorizaton can be effectively carried out to such an extent that the dephosphorization in the next step is not necessary and therefore if dephosphorizaton is added in the next step of refining in converter, super-low phosphorus steel can be simply and easily made. In addition, in the above described prior process, an amount of manganese is remarkably reduced in the treatment of molten pig iron, while in the invention, at least 80% of manganese prior to treatment remains and therefore if the refining in converter in the next step is carried out in slagless, the decrease of Mn does not substantially occur, so that the yield of Mn through the whole steps is improved.

In the above described prior process, the formation of a slag having a low melting point is necessary for promoting the contact reaction and the basicity becomes necessarily low and therefore T·Fe of the slag should be increased in order to realize a high dephosphorizing ability, while in the invention, the dephosphorization does not depend upon T·Fe in the slag, so that it is not necessary to increase T·Fe and the dephosphorizaton can be advantageously carried out at low temperatures by using iron ore and other iron series coolant and the reduction of the coolant can be completely carried out, so that the yield of iron is high and T·Fe in the slag is low, so that the durable life of the refractory is not adversely affected and the erosion of the refractory can be advantageously reduced and an amount of slag formed is small. In general, in the converter refining of molten pig iron having a level of Si of 0.30%, even in the best condition, about 70 kg/t of slag is formed, while in the invention, the formation of slag is reduced to about 35 kg/t. Accordingly, if the treatment of molten pig iron according to the invention and the subsequent slagless refining are combined, the amount of slag formed in steel making step can be broadly reduced.

As a secondary effect, the remarkable desulfurizing function is far more highly realized than the usual refining in converter and in the usual steel making, the desulfurizing step is not necessary and in low sulfur steel making, the load in the desulfurizing step can be remarkably reduced and this is shown in FIG. 11.

EXAMPLE 6

This example illustrates the case where a lumpy flux of fluorite is charged into a bottom-blown converter from a top opening and the other treatment manners follow to the manner as mentioned in the preceding examples. The treating conditions in this example are shown in Table 6. Table 6 shows also the results in the above mentioned process wherein the powdery refining agent and the powdery flux are blown with bottom-blowing oxygen into the converter, for comparison with the results in this example.

TABLE 6

| Test No. | Components of molten pig iron before treatment (wt. %) | | | | | Temperature of molten pig iron | Components of molten pig iron after treatment (wt. %) | | | | | Temperature molten pig iron | Amount of CaO used | Amount of fluorite | Amount of molten pig iron charged |
|---|---|---|---|---|---|---|---|---|---|---|---|---|---|---|---|
| | C | Si | Mn | P | S | (°C.) | C | Si | Mn | P | S | (°C.) | (ton) | (ton) | (ton) |
| 1 | 4.63 | 0.19 | 0.22 | 0.130 | 0.014 | 1,385 | 3.37 | tr | 0.17 | 0.009 | 0.009 | 1,375 | 5.05 | 0.50 | 261 |
| 2 | 4.64 | 0.30 | 0.24 | 0.143 | 0.009 | 1,415 | 3.70 | tr | 0.19 | 0.010 | 0.008 | 1,365 | 7.96 | 0.20 | 257 |
| 3 | 4.72 | 0.22 | 0.31 | 0.136 | 0.023 | 1,382 | 3.86 | tr | 0.19 | 0.012 | 0.015 | 1,342 | 5.20 | 0.30 | 250 |
| 4 | 4.70 | 0.30 | 0.44 | 0.151 | 0.018 | 1,384 | 3.81 | tr | 0.36 | 0.012 | 0.012 | 1,377 | 5.85 | 0.65 | 260 |
| 5 | 4.68 | 0.44 | 0.52 | 0.150 | 0.022 | 1,371 | 3.96 | tr | 0.36 | 0.014 | 0.010 | 1,377 | 10.27 | 1.00 | 263 |
| 6 | 4.56 | 0.10 | 0.34 | 0.149 | 0.018 | 1,346 | 3.26 | tr | 0.19 | 0.011 | 0.012 | 1,320 | 5.24 | 0.95 | 251 |

Note:
Test Nos. 1–3: Lumpy fluorite was charged from the top opening of the bottom-blown converter.
Test Nos. 4–6: Powdery fluorite was charged from bottom tuyere together with a refining agent.

By the treatment as described above, the cost for pulverizing fluorite (electric power and heating cost for removing water) becomes zero and maintenance cost of installation for pulverizing fluorite and transportation pipes is not necessary. When installations for pretreatment of molten pig iron by means of bottom-blown refining vessel are newly provided, a pulverizer for fluorite has been needed other than a pulverizer for calcium oxide but the pulverizer for fluorite is not needed and the installation cost can be lowered.

In this example, the amount of the flux used can be reduced without decreasing the dephosphorizing activity as compared with the case where the powdery refining agent and the powdery flux are blown with an oxygen blowing gas into the bottom-blown converter and the pulverizing process may be omitted.

In this example, a bottom-blown converter was used as the refining vessel but the top and bottom-blown converter may be used.

EXAMPLE 7

260 tons of molten pig iron having 0.09% by weight of Si, which has been tapped from a blast furnace, was charged into a bottom-blown converter and then 24 kg/t of iron ore was charged therein and 19 kg/t of powdery CaO as a refining agent was blown with 8 $Nm^3/t$ of oxygen at an oxygen blowing rate of 2.5 $Nm^3/t\cdot min$ into molten pig iron in the converter and 4 kg/t of fluorite was charged from the converter top to effect the pretreatment of the molten pig iron. The obtained result is shown in Table 7 and the dephosphorizaton ratio reached 98%.

TABLE 7

| | Chemical components of molten pig iron (wt. %) | | | | | Temperature of molten pig iron (°C.) |
|---|---|---|---|---|---|---|
| | C | Si | Mn | P | S | |
| Before treatment | 4.55 | 0.09 | 0.23 | 0.110 | 0.018 | 1,307 |
| After treatment | 3.21 | tr | 0.11 | 0.002 | 0.012 | 1,310 |

EXAMPLE 8

To molten pig iron tapped from a blast furnace were fed CaO and iron ore and the desiliconization was effected until a content of Si was 0.04% by weight, 250 tons of the thus formed low Si pig iron was charged into a bottom-blown converter and then 4 kg/t of iron ore was charged therein and then 16 kg/t of powdery CaO and 4 kg/t of fluorite were blown with 9 $Nm^3/t$ of bottom-blowing oxygen gas as a carrier gas at an oxygen blowing rate of 2.8 $Nm^3/t \cdot min$ therein. The obtained result is shown in Table 8 and the dephosphorization ratio was 93%.

TABLE 8

| | Chemical components of molten pig iron (wt. %) | | | | | Temperature of molten pig iron (°C.) |
|---|---|---|---|---|---|---|
| | C | Si | Mn | P | S | |
| Before treatment | 4.35 | 0.04 | 0.27 | 0.113 | 0.019 | 1,281 |
| After treatment | 3.38 | tr | 0.17 | 0.008 | 0.011 | 1,345 |

In the above described Examples 7 and 8, a bottom-blown converter was used as a refining vessel, as far as a vessel has the similar function thereto, a top and bottom-blown converter in which top-blowing oxygen can be blown into the converter and the other iron making vessels having the similar function may be applied to the invention as a refining vessel.

As mentioned above, according to the invention, in the pretreatment of a low Si pig iron having Si content of less than 0.15% by weight, the dephosphorizaton can be effectively attained to such an extent that the dephosphorization in the subsequent step is not necessary and when the dephosphorizaton is added in the next step of refining in converter, the super-low phosphorus steels can be simply and easily made.

What is claimed is:

1. A method of preliminarily dephosphorizing molten pig iron, wherein said molten pig iron is charged into a refining vessel provided at its bottom with tuyeres for blowing gas and at its top with a gas injecting member, and a powdery refining agent, consisting of a calcium oxide compound and acting to produce a dephosphorization reaction, together with said blowing gas is blown into said molten pig iron through said tuyeres, while a flux, adding together with said refining agent to said molten pig iron for reducing the viscosity and melting point of the resulting slag, is charged into said refining vessel to perform desiliconization and subsequent dephosphorization of said molten pig iron, which method comprises:

(a) charging a coolant together with said molten pig iron into said refining vessel to control the temperature of said molten pig iron during the blowing in a range of 1,250°–1,450° C.;

(b) blowing said powdery refining agent into said molten pig iron so as to adjust a value of slag basicity after the treatment to not less than 2.5; and (c) blowing said blowing gas at a rate of not less than 0.5 $Nm^3/min$ per ton of molten pig iron so that a net oxygen quantity is 8–15 $Nm^3$ per ton of molten pig iron.

2. A method as claimed in claim 1, wherein said coolant is at least one material selected from iron ore, manganese ore, mill scale and scrap.

3. A method as claimed in claim 1, wherein said powdery refining agent is at least one of calcium oxide and calcium carbonate.

4. A method as claimed in claim 1, wherein said flux is at least one material selected from fluorite, soda ash, cryolite, colemanite and red mud.

5. A method as claimed in claim 1, wherein said powdery refining agent is charged in an amount of not less than 12 kg per ton of molten pig iron and said flux is charged in an amount of not less than 2 kg per ton of molten pig iron.

6. A method as claimed in claim 1, wherein said flux is charged onto molten pig iron from the top of said refining vessel.

7. A method as claimed in claim 1, wherein said flux is mixed with said powdery refining agent and blown into molten pig iron together with said blowing gas through said tuyeres.

8. A method as claimed in claim 1, wherein said flux is simultaneously charged from the top of said refining vessel and through said tuyeres at the bottom of said refining vessel.

9. A method as claimed in claim 1, wherein said refining vessel is a bottom-blown converter.

10. A method as claimed in claim 1, wherein said refining vessel is a top and bottom-blown converter.

* * * * *